US009267252B1

(12) United States Patent
Adler et al.

(10) Patent No.: US 9,267,252 B1
(45) Date of Patent: Feb. 23, 2016

(54) REMOVABLE FLOOD CONTROL COVER SYSTEM FOR UNDERGROUND FACILITY VENTS AND OPENINGS

(71) Applicant: RSA PROTECTIVE TECHNOLOGIES, LLC, Claremont, CA (US)

(72) Inventors: Richard S. Adler, Claremont, CA (US); David Toyne, Tujunga, CA (US)

(73) Assignee: RSA PROTECTIVE TECHNOLOGIES, LLC, Claremont, CA (US)

( * ) Notice: Subject to any disclaimer, the term of this patent is extended or adjusted under 35 U.S.C. 154(b) by 0 days.

(21) Appl. No.: 14/295,052

(22) Filed: Jun. 3, 2014

Related U.S. Application Data

(60) Provisional application No. 61/996,642, filed on May 12, 2014, provisional application No. 61/996,103, filed on Apr. 28, 2014, provisional application No. 61/961,046, filed on Oct. 2, 2013, provisional application No. 61/956,204, filed on Jun. 3, 2013.

(51) Int. Cl.
*E02D 29/14* (2006.01)
*E02B 3/16* (2006.01)
*E03F 5/04* (2006.01)

(52) U.S. Cl.
CPC . *E02B 3/16* (2013.01); *E02D 29/14* (2013.01); *E03F 5/04* (2013.01)

(58) Field of Classification Search
CPC ..... E03F 5/04; E03F 5/0404
See application file for complete search history.

(56) References Cited

U.S. PATENT DOCUMENTS

| | | | | |
|---|---|---|---|---|
| 3,032,062 | A * | 5/1962 | Blahnik | 137/593 |
| 3,445,973 | A * | 5/1969 | Stone | 4/295 |
| 4,838,732 | A * | 6/1989 | Clark et al. | 405/52 |
| 4,988,234 | A * | 1/1991 | Henkel et al. | 405/36 |
| 5,527,131 | A * | 6/1996 | Salmond et al. | 405/52 |
| 6,530,722 | B1 * | 3/2003 | Shaw et al. | 405/52 |
| 6,769,834 | B1 * | 8/2004 | Stange | 404/25 |
| 8,051,568 | B2 * | 11/2011 | Moody et al. | 29/896.62 |
| 2005/0262624 | A1 * | 12/2005 | Evans et al. | 4/293 |
| 2008/0145150 | A1 * | 6/2008 | Shaw et al. | 405/52 |

* cited by examiner

*Primary Examiner* — Benjamin Fiorello
(74) *Attorney, Agent, or Firm* — Stephen J. Lieb; Frommer Lawrence & Haug LLP

(57) ABSTRACT

A cover system for covering an opening, e.g., to an underground facility, watertight, includes one or more waterproof panels and a seal gasket for each panel, or a seal gasket common to a plurality of panels, configured to extend peripherally relative to the panel(s) and the opening, and adapted to be positioned between the panel(s) and the periphery of the opening, and one or more clamping devices for each panel which engage the respective panel and the periphery of the opening and/or structure extending over and attached to the opening to clamp the respective panel over the opening and compress the respective seal gasket.

8 Claims, 21 Drawing Sheets

REMOVABLE FLOOD CONTROL COVER SYSTEM FOR UNDERGROUND FACILITY VENTS AND OPENINGS

RELATED APPLICATIONS

This application claims benefit to provisional Application Nos. 61/956,204, filed on Jun. 3, 2013, 61/996,642 filed on May 12, 2014, 61/996,103, filed on Apr. 28, 2014, 61/961,046 filed Oct. 2, 2013, the disclosures of all of which are incorporated herein by reference.

The disclosures of provisional Application No. 61/855,540 filed on May 16, 2013, and non-provisional application Ser. No. 14/295,074 titled "A Flood Control System Panels for Subway Entrance", filed on Jun. 3, 2014, are also incorporated herein by reference.

BACKGROUND

The invention disclosed herein relates generally to a cover system for preventing water from entering underground facilities through openings, e.g., for ventilation (e.g., air, light, etc.) and/or ingress/egress, e.g., for facilities such as transportation facilities, garages, storage facilities, vaults, data centers, basements, electrical equipment facilities, generators, electrical conduit and junction facilities, etc. "Underground facilities" is meant herein in a broad sense and encompasses interior facilities below floor level, such as ventilation or electrical conduit floorings.

Underground facilities, such as, but not limited to, those mentioned above, are under the threat of being flooded due to heavy rains, hurricanes, and storm surges, not only in areas traditionally prone to flooding close to rivers and shorelines, but also in metropolitan areas not traditionally flooded. For example, in 2012, The New York City subway system experienced unprecedented damage caused by storm surge and flood waters from Superstorm Sandy. At other times, parts of the NYC subway system were flooded to a much lesser extent from torrential rains. Much of such flooding was caused by water entering the subway system through entrances and air vents.

SUMMARY

Embodiments presented in this application provide a cover system that covers and seals openings to low level or underground facilities. For example, such an opening may be at ground level (or if interior to a structure, at floor level). ("Ground level" is meant herein in a broad sense and encompasses levels near ground/floor level, as well as at ground/floor level. "Ground level" may also be used herein in a relative sense referring to the ground/floor at the particular location of an opening, which may not be at ground/floor level relative to the area nearby or surrounding the particular location. For example, a vent or entrance may be at sidewalk level, which is above street level, or above or below stairs, which are above or below a surrounding area, etc.) Such cover systems can substantially reduce the amount of water that might otherwise enter an underground facility due to ground water levels.

Examples of such facilities include subway entrances and air vents, basement vents, electrical system vents or access openings (e.g., of the local electrical company).

The cover system according to one or more embodiments comprises a waterproof panel and a seal gasket configured to extend peripherally relative to the panel and the opening, and adapted to be positioned between the panel and the periphery of the opening. Clamping or other securement devices are provided that engage the panel and the periphery of the opening and/or structure extending over and attached to the opening (e.g., a grate or a ledge) to clamp the panel over the opening and compress the seal gasket.

The cover system according to another of these embodiments comprises a plurality of waterproof panels and a seal gasket system configured to extend peripherally relative to each panel and between adjacent panels. Clamping or other securement devices are provided that engage a respective panel and the periphery of the opening and/or structure extending over and attached to the opening to clamp the panels over the opening and compress the seal gasket system. In embodiment, the clamping devices clamp the panel to a plurality of grates or grate sections over the opening.

According to some multiple panel cover system embodiments, a flashing is provided to span an opening between adjacent panels (or a space between smaller openings which together define a larger opening), and the seal gasket system extends over each flashing. The flashing may be supported by structure extending over or between portions of the opening (e.g., a grate), or the flashing may comprise a support member extending over the opening supported by structure in the opening (e.g. a ledge) which supports in part a panel.

According to some devices, clamping or other securement devices can be operated from above the particular opening, and in some embodiments from below or from within the opening. According to some embodiments, the cover system includes an opening therein by which a clamping device can be operated from above the opening to be covered, and an arrangement for making the opening watertight from above. According to some embodiments, a clamping device may comprise a part on the top or side of a cover by which a clamping device can be operated. A linkage into the cover to other parts of the clamping device is made watertight from above.

Various embodiments of panels, panel assemblies, seal gaskets and gasket systems, flashings and supports, and clamping/securement devices, and structures of cover systems are described herein Various embodiments of cover systems are adapted to cover various configurations of vent openings and various configurations of entrance openings, which may include grates covering the opening(s) and/or ledges, at an opening side or sides, and/or sidewalls or fence structures surround parts of the openings, etc.

In accordance with some embodiments, the cover systems are storable, quickly deployable from storage, and quickly installable without special tools. In accordance with some embodiments, the cover systems are also relatively lightweight and can be handled and installed manually.

According to some embodiments, the cover systems not only are transportable to a particular site, but are removable, thus allowing a cover system to be temporarily used during a storm or flood event and thereafter removed and re-stored.

Panels of cover systems of some embodiments are of minimal height in order to present a low profile and reduce the risk that a pedestrian will trip on the panel and to facilitate passage over a panel of a vehicle (e.g., car or truck, carriage, stroller, bicycle, etc.) or equipment. According to some embodiments, one or more panel sides are beveled to provide a smooth transition from ground level to the top of the panel and thereby reduce the risk that a pedestrian would trip on the panel, or to facilitate travel over a panel by a vehicle or equipment. According to some embodiments, the panels are constructed to bear pedestrian, equipment and/or vehicular traffic.

According to an embodiment, a cover system for covering a facilities opening watertight, comprise a waterproof panel, a seal gasket configured to extend peripherally relative to the panel and the facilities opening, and adapted to be positioned between the panel and the periphery of the opening, and one or more clamping devices which engage the panel and the periphery of the facilities opening and/or structure extending over and attached to the facilities opening to clamp the panel over the facilities opening and compress the seal gasket.

According to an embodiment, the panel comprises a clamping device opening in the top thereof for each clamping device and a lid which attaches to the respective clamping device opening watertight, a respective clamping device being accessible through the respective clamping device opening without the respective lid.

According to an embodiment, at least one of the clamping devices comprises a hook structure at the bottom thereof which is adapted to engage a bar of a grate installed over the facilities opening.

According to an embodiment, at least one of the clamping devices comprises a hook structure at the bottom thereof which is adapted to engage a ledge or other structure associated with the facilities opening.

According to an embodiment, at least one of the clamping devices comprises a hook structure at the bottom thereof which is adapted to engage a beam extending over the facilities opening.

According to an embodiment, the seal gasket is attached to the panel, and the panel with at least the seal gasket forms an assembly installable as one piece.

According to an embodiment, the panel comprises a top plate defining an enclosure with an open end, a frame disposed within the enclosure, and a bottom plate attached to the top plate closing the enclosure.

According to an embodiment, wherein the seal gasket comprises a flange which is held between the top plate and the bottom plate at the periphery of the open end of the enclosure to attach the seal gasket to the panel, at least the top plate, the frame, the bottom plate and the seal gasket forming an assembly installable as one piece.

According to an embodiment, the cover system comprises a gasket frame plate attached to the periphery the open end of the top plate, and wherein the seal gasket is disposed between the gasket frame plate and the bottom plate.

According to an embodiment, the cover system comprises a housing within the panel for each clamping device, the housing comprising an upper end having threads thereon, wherein the lid comprises threads mating with the threads of the housing to provide a watertight when the lid id threaded to the housing.

BRIEF DESCRIPTION OF DRAWINGS

Certain exemplary embodiments are described herein in connection with the following description and the annexed drawings. The following description and drawings are given by way of example, and not limitation, and the claims are not intended to be limited only to the specific details of the description and drawings.

DETAILED DESCRIPTION

Figure 1A:
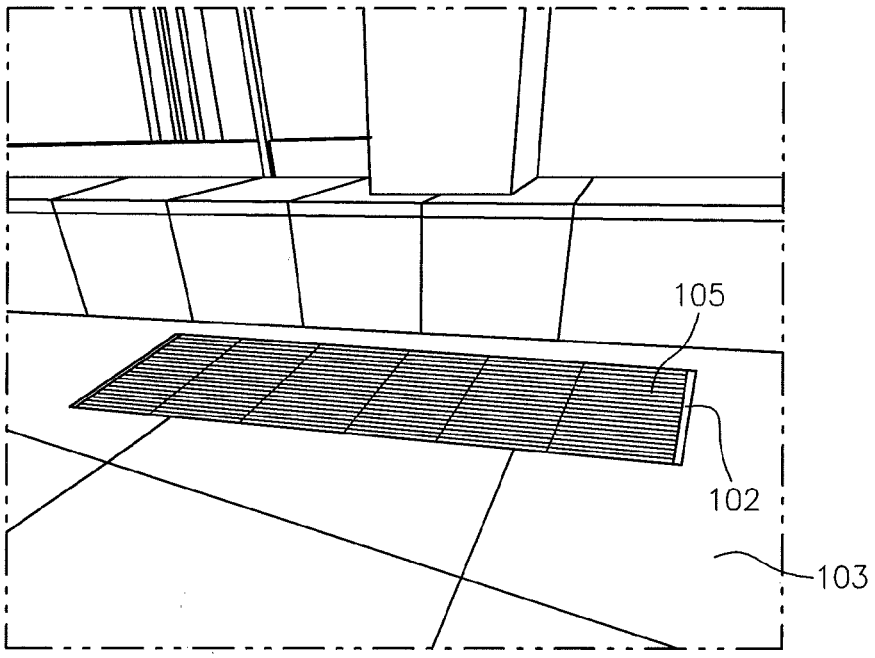
FIG. 1A is a perspective view of a sidewalk vent opening covered by a grate and FIG. 1B is a perspective view of the vent opening and an embodiment of a panel of cover system for sealing the opening.

Embodiments of cover systems, components, and methods of installation are disclosed or are apparent from and encompassed by the description herein. Not all embodiments disclosed herein are specifically illustrated in the drawings, but their construction will be apparent to one of skill in the art from the disclosure herein. Also, the specific embodiments described below and shown in the drawings are exemplary.

Figure 2A:
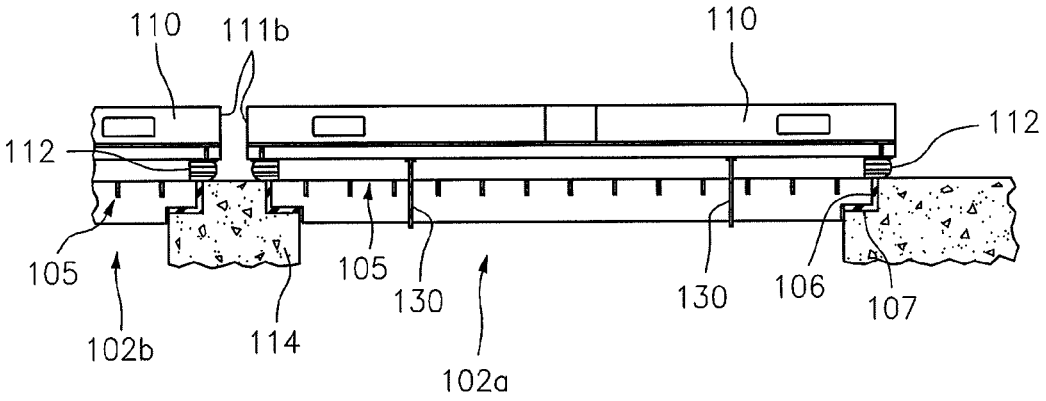
FIGS. 2A and 2B are side elevation views, partially in section, of the vent opening depicted in FIGS. 1A and 1B and two of the panels depicted in FIG. 1B covering the opening, also showing a gasket system, structure internal to the panels of the cover system, and clamping devices.
Figure 2B:
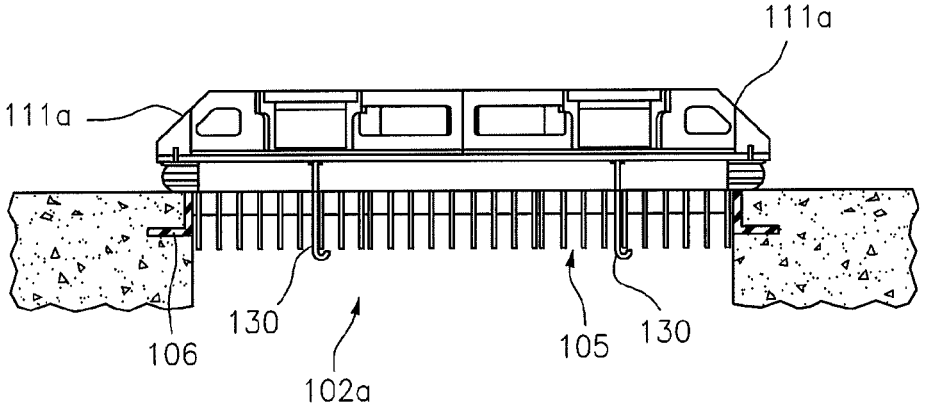

FIG. 1A depicts an opening 102 in a sidewalk 103 covered by a grate 105. The opening 102 may function as a vent (for air and/or light) of an underground facility such as a subway, or a building basement, or a below sidewalk vault, or part of a utility system, or an underground storage facility or data center, etc. Grates may be secured to such openings in known fashion, for example as depicted in FIGS. 2A and 2B, using brackets or angle irons 107 and/or ledges 108. When the opening 102 is at ground level (e.g., sidewalk or street level), the grate would be typically attached at ground level so as to be flush with the ground. A grate allows air and light to pass therethrough, and in addition, water which in large quantities may not be desirable.

A cover system 108 according to an embodiment (FIGS. 1B, 2A and 2B) comprises a panel or panels 110 sized to cover an opening 102 and, at least with a seal gasket 112 (FIGS. 2A and 2B), provide a watertight seal for the opening. The particular embodiment of a cover system 108 depicted in FIGS. 1B, 2A and 2B comprises two panels 110 (FIG. 2A), sized so together they cover the opening 102, and with the seal gaskets 112, provide a water-tight seal for the opening 102.

As shown in FIG. 2A, the opening 102 comprises two openings 102*a* and 102*b* separated by a support 114 (e.g., a beam or a sidewalk portion). Each opening 102*a*, 102*b* is covered by a respective panel 110.

The size of a particular panel of a cover system may vary, and may depend upon the size of the opening(s) to be covered and the desired handleability of the panel (i.e., manually or with the aid of lifting and/or other equipment). For example, a panel constructed in accordance with the disclosure herein having a size of about 4 ft 8 in by 6 ft 3 in (to cover a 4 ft by 6 ft opening or, with two panels, a 4 ft by 12 ft opening) may be handled and installed manually. Two such panels may be used to cover a 4 ft by 12 ft opening, e.g., as shown in FIGS. 1A,B and 2A,B. Such panels may be stored, and when needed, transported and then installed manually, e.g., without special tools. Thereafter, the panels may be manually removed, and transported back for storage. However, other sized panels may be provided that may be handled manually, and/or with the aid of lifting, motorized and/or other equipment.

According to an embodiment, the surface of a cover system panel may have a layer of an abrasive coating or coatings such as a layer of rubber and/or a layer of anti-slip paint. According to another embodiment, a cover system panel may have a color distinct from its surroundings to warn vehicles or pedestrians of the existence of the panel. According to another embodiment, a cover system panel may have a color similar with its surroundings, which integrates the existence of the cover system with the general aesthetic feeling of its adjacent environment.

Figure 1B:
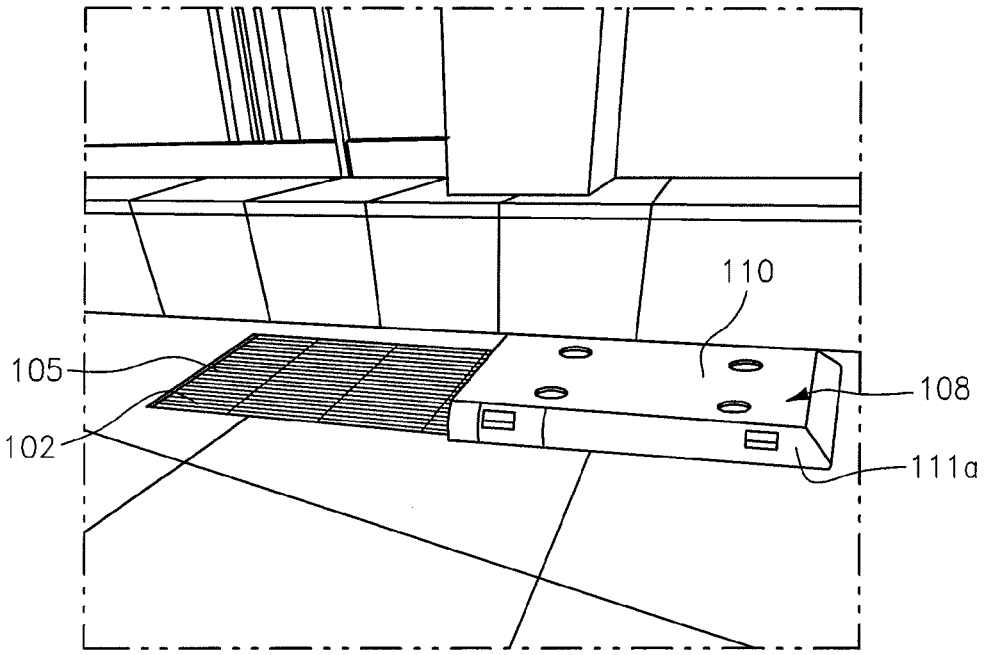
Figure 3:
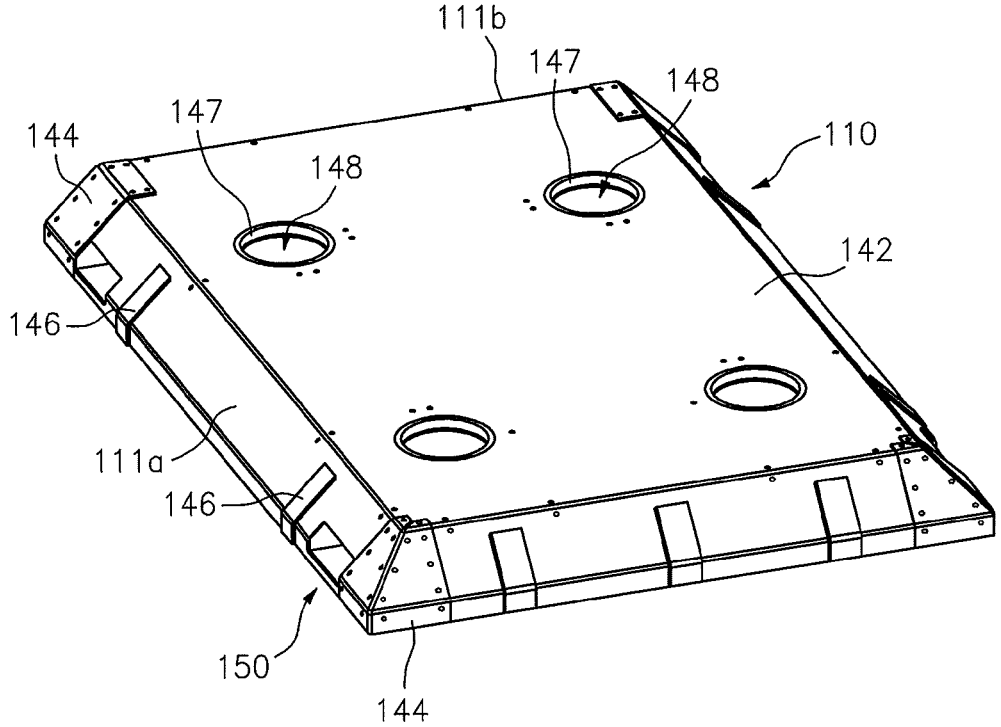
FIG. 3 is a top perspective view of the panel of the cover system depicted in FIG. 1B.
Figure 7:
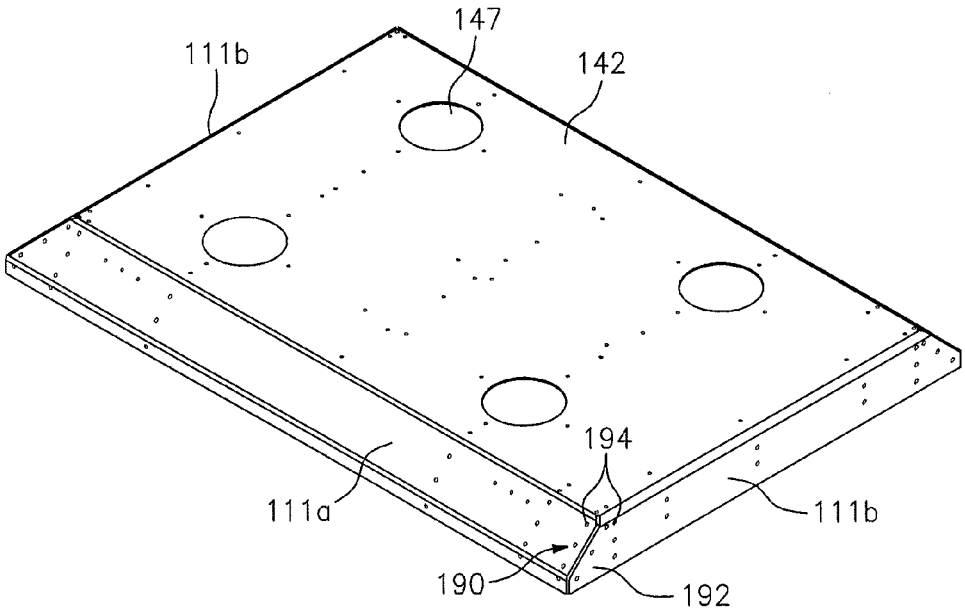
FIG. 7 is a top perspective view of a top plate of the panel depicted in FIG. 3.

According to some embodiments, a panel may be provided with one or more beveled sides 111*a*, as depicted in FIGS. 1B, 2A and 3. A beveled side provides a transition between ground level and the top of a panel so as to reduce the risk that a pedestrian would trip on the panel, or facilitates travel over a panel of a vehicle (e.g., car or truck, carriage, stroller, bicycle, etc.), or equipment. In some embodiments, one or more sides 111*b* (FIG. 2A) may be squared, e.g., at adjacent sides of a multi-panel cover system (FIGS. 2A and 7).

The particular opening 102*a*, 102*b* depicted in FIGS. 2A and 2B is closed by grates 105, one for each opening. (The cover system disclosed herein is applicable to other openings, whether closed by a grate or not, or covered by a plurality of grates, and to various grate structures.) A panel 110 covers each opening 102*a*, 102*b*, and is supported, via a gasket seal 112, at its periphery by sidewalk or other ground structure, or a frame supported by ground structure, etc. A strip of sidewalk, or other ground structure, or a ledge and/or brackets, etc., or a frame, or a beam, etc., separates holes 102*a*, 102*b*, and one side of each of the panels 110 is supported thereon (FIG. 2A). Sides of each grate 105 may be supported on a ledge 107, directly or via a bracket or angle iron, or on a beam, or are attached to an angle iron 106 embedded in or otherwise supported by sidewalk or other ground structure, or a frame. Such a beam straddles the opening and functions as a support for one or more cover panels. Each grate 105 may comprise various arrangements of longitudinal and/or transverse bars 124 attached in various ways.

Referring to FIGS. 2A and 2B, a seal gasket 112 is positioned at the bottom periphery of a panel 110 sandwiched between the panel and the peripheral surface surrounding the opening 102*a*, 102*b*. The actual position of the seal gasket may vary, i.e., a seal gasket may be positioned entirely within the bottom periphery of a panel, as shown in FIGS. 2A and 2B, or partially within and partially extending outwardly of the panel periphery. Similarly, a seal gasket may be positioned entirely outside of the respective opening, as shown in FIGS. 2A and 2B, or partially within and partially outside of the opening. Where an opening comprises smaller openings separated by a support (e.g., strip 114, described below as flashing), as depicted in FIG. 2A, for example, one side of a seal gasket is positioned on the strip 114.

Each panel is clamped down to cover a respective opening and compress a respective seal gasket to form a watertight seal of a panel to the opening. According to one embodiment, clamping devices attached to a panel protrude from the bottom thereof and engage a bar of a grate. The clamping devices include a tightening mechanism, operable from above the panel, which causes the panel to be drawn to the grate as tightened, and compress the seal gasket. The compression of the seal gasket by the clamping devices and the weight of the panel create a watertight seal of the panel over the opening.

Figure 19:
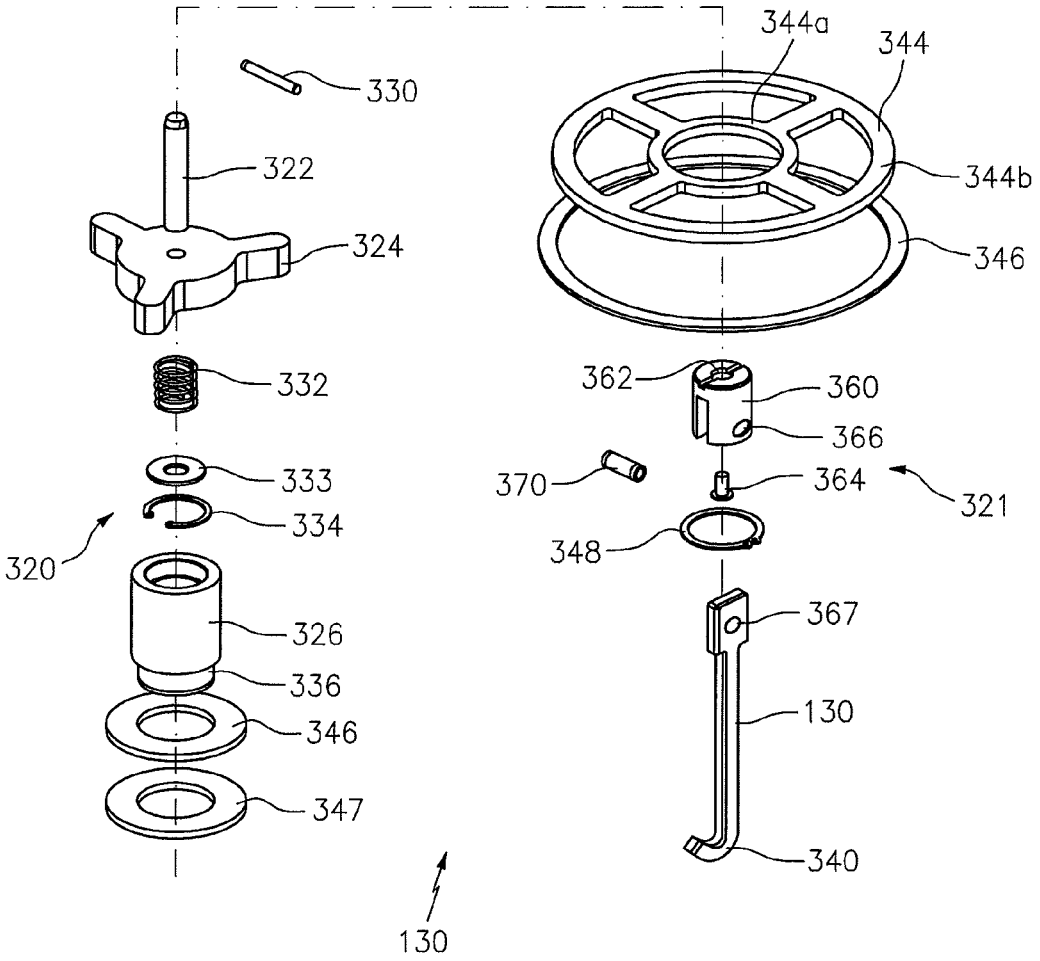
FIG. 19 is on exploded perspective views showing components of a clamping device.
Figure 20:
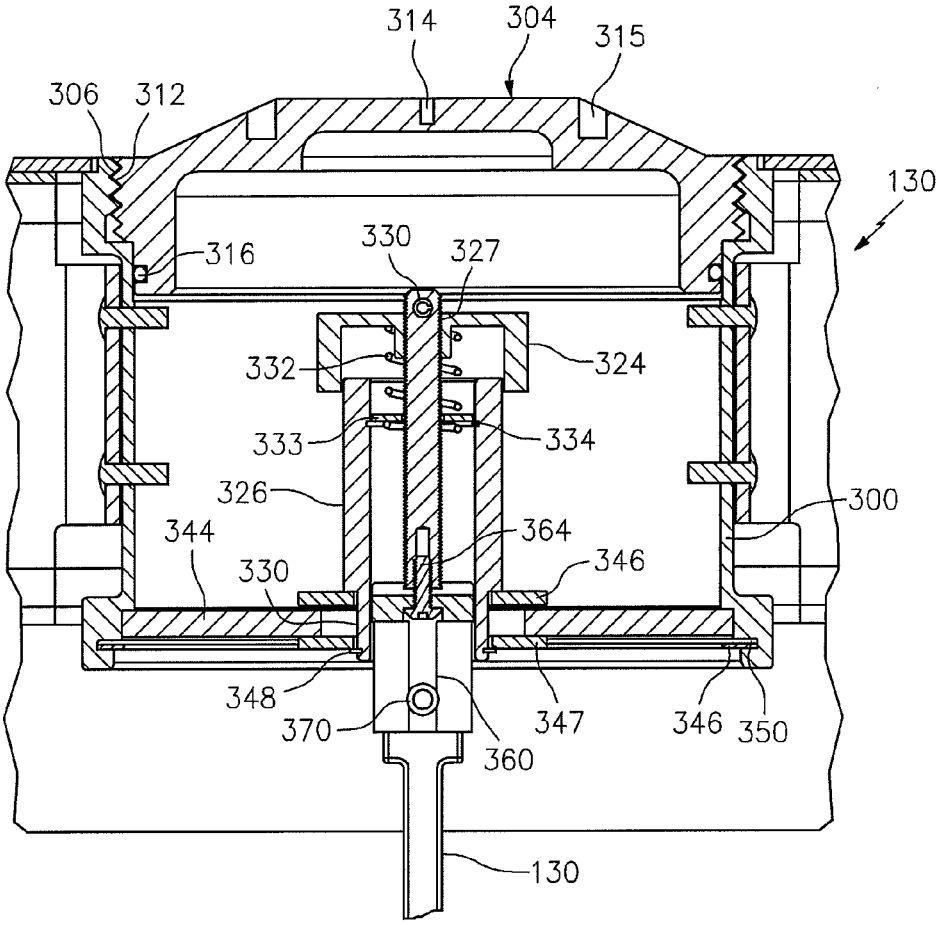
FIG. 20 is an axial section view of a clamping device compartment and components.

In one embodiment, the clamping devices comprise a J-hook 130 (FIGS. 2A and 2B), or another engaging structure, and a tightening mechanism comprising a threaded rod 322 attached to the J-hook (FIGS. 19-20). The hook portion of the J-hook hooks below and engages a grate bar, and the J-hook can be moved via the threaded rod and a handle to clamp the panel to the grate. This clamping device is discussed in more detail below in connection with FIGS. 19-20.

Figure 23:
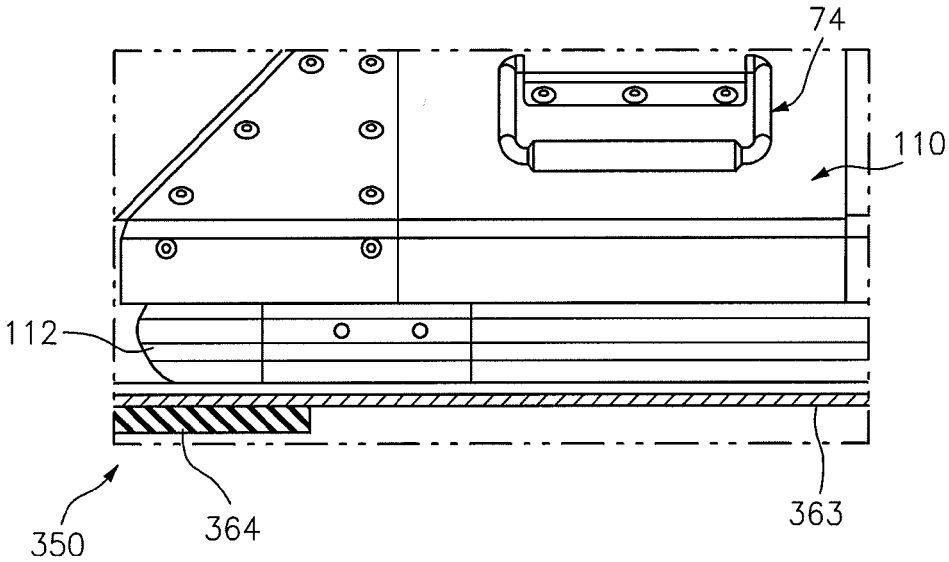
FIG. 23 is a side elevation view showing a panel and seal gasket installed with the flashing system.

A panel 110 (FIG. 3) of the cover system 108 includes a top plate 142. According to one embodiment, the top plate 142 is reinforced at its corners by a plurality of corner plates 144 and, at its sides, by a plurality of side brackets 146. The panel 110 also includes a plurality of openings 147 for clamping device compartments 148 which accommodate the clamping devices. The panel 110 may optionally include a plurality of pocket or recessed handles 150 sized to receive part of an installer's hand, or other structure such as a exposed or flush handles (74 in FIGS. 5 and 23), for lifting, carrying and installing the panel. The top plate 142 and its associated components may be made of any suitable material that provides the required structural strength and satisfies use and environmental constraints, including aluminum, metal alloy, stainless steel, composites, plastic, etc. According to one embodiment, the top plate and its associated components are made of an aluminum alloy, such as Alloy 6061-T6 or 5052-H4.

Figure 4:
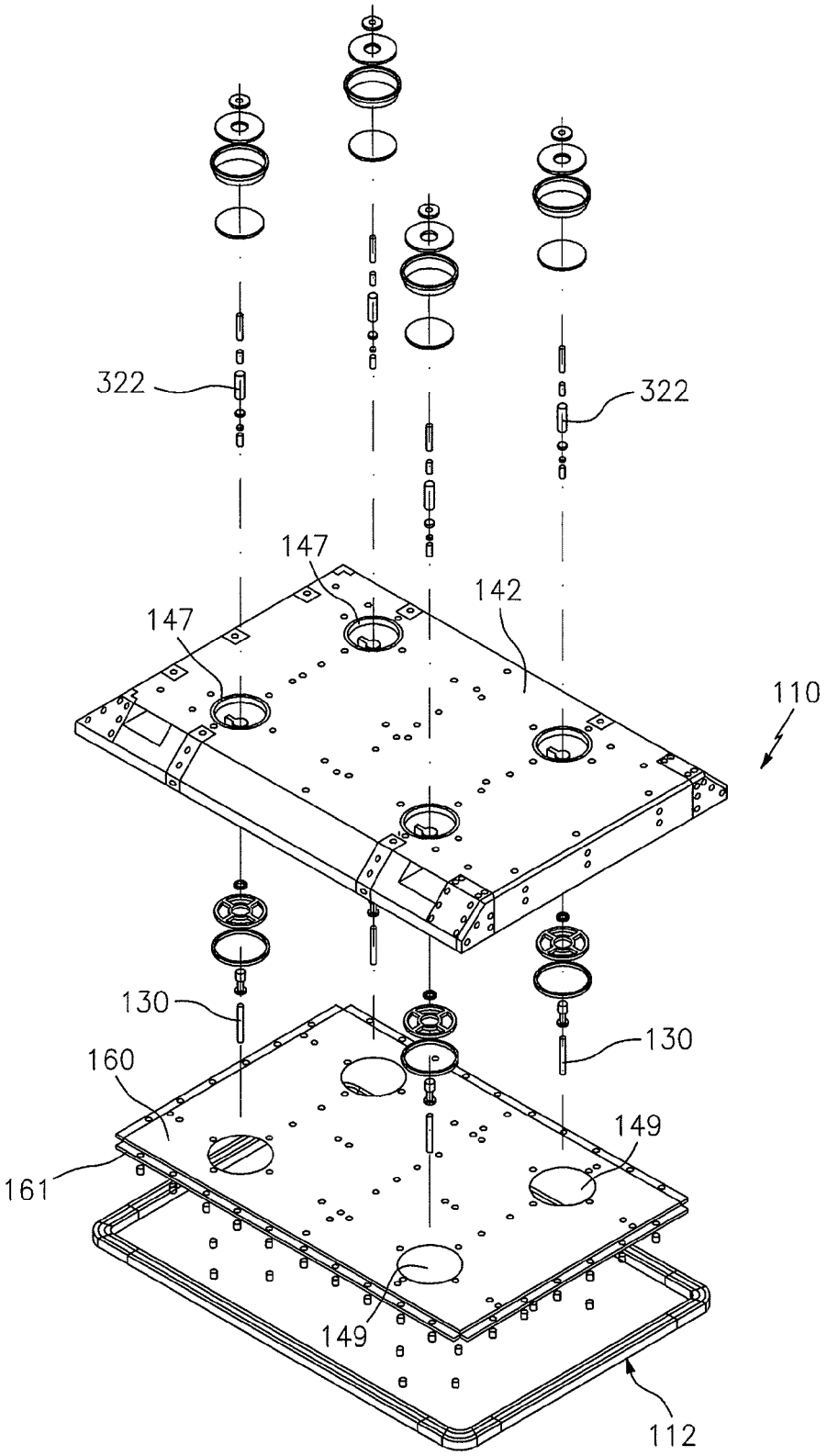
FIG. 4 is an exploded perspective view of the top and bottom plates of the panel depicted in FIG. 3 and a seal gasket of the cover system.

As depicted in FIG. 4, a panel 110 includes in addition to top plate 142, a bottom plate 160 having a raised skirt 161 used to create a seal at the bottom of the cover panel. The seal gasket 112 is attached as described below in connection with FIGS. 16, 21, 5, 15A, B, C and 16. The top and bottom plates include openings 147, 149 for the clamping device. The bottom plate 160 and the gasket 112 isolate the internal components of the panel and seal the bottom of the panel. The internal components shown in FIGS. 5 and 6 are discussed in detail below in connection with FIGS. 11-12.

Figure 5:
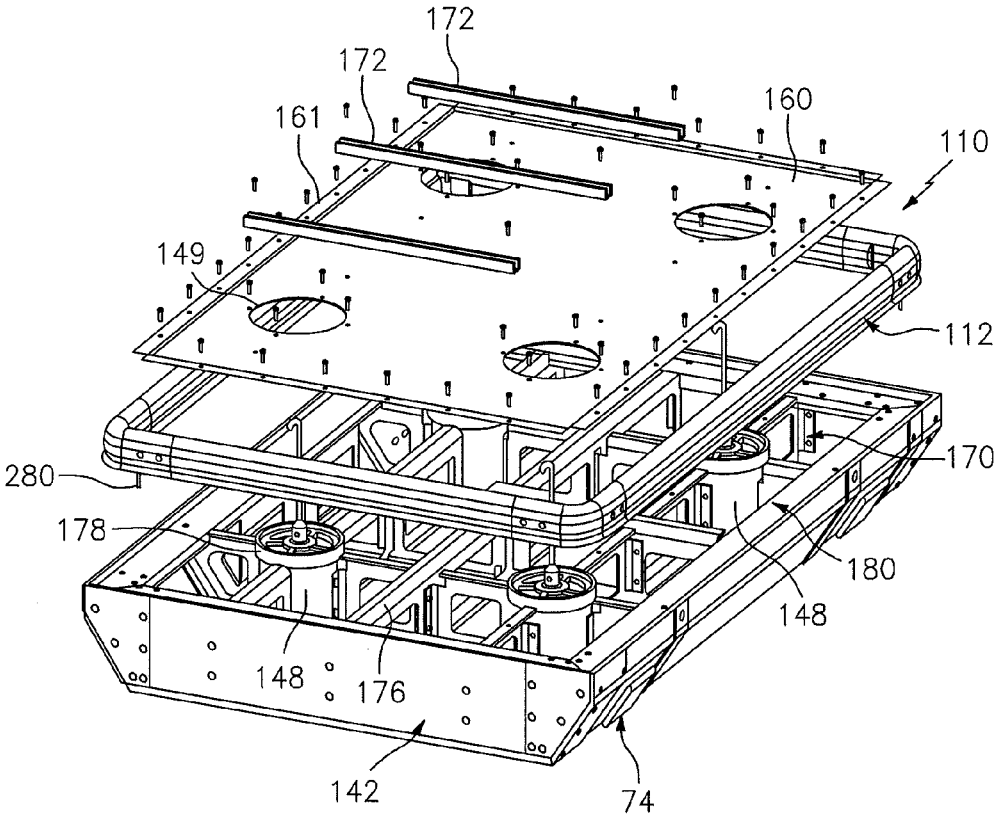
FIG. 5 is an exploded perspective view of the bottom of the panel and the seal gasket depicted in FIG. 3, also showing a support frame disposed within the panel.
Figure 6:
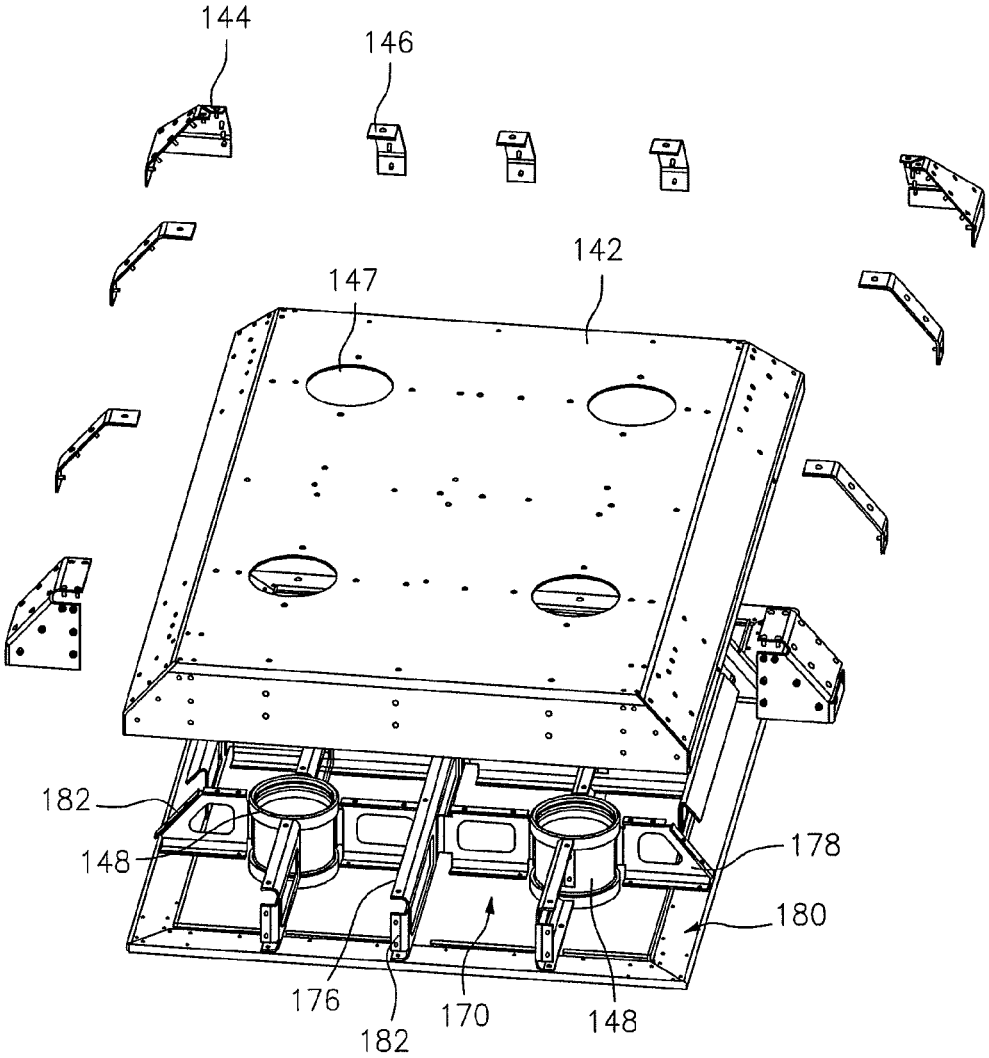
FIG. 6 is a top exploded perspective view of the top plate of the panel depicted in FIG. 3 and the support frame.

As depicted in FIGS. 5 and 6, the panel 110 forms a watertight enclosure comprising an open lower end. An internal frame 170 is disposed in the enclosure for support and structural strength between the top and bottom plates to resist the weight of water above the panel and/or loads applied to the top plate from pedestrian or vehicular traffic. In addition, the panel 110 may also comprise a plurality of supporting beams or ribs 172 attached in any suitable way (e.g., fasteners, adhesives, etc.) to the exterior of the bottom plate 160 to provide clearance between the bottom plate 160 and the vent grate 105 (FIG. 2A) and to provide additional support between the panel and the vent grate.

Referring to FIGS. 5-6, the frame 170 comprises a plurality of longitudinal ribs 176, a plurality of transverse ribs 178, a frame gasket plate 180 extending about the periphery of the enclosure opening, and the clamping device compartments 148. The ribs are attached to each other and to the clamping device compartments 148, and some to the gasket frame plate 180, in any suitable manner, e.g., by fasteners. The clamping device compartments 148 are positioned at intersections of the longitudinal and transverse ribs. The frame 170 is discussed in more detail below.

Referring to FIG. 5, the frame 170 is attached within the top plate 142 in any suitable manner. For example, the longitudinal and transverse ribs may end in brackets 182 (or have brackets attached thereto) which are attached to the interior sides of the top pate 142, e.g., by fasteners or adhesive. Alternatively, or in addition, a lip may be provided around the periphery of the top plate 142, and the gasket plate 180 may be attached to the lip. The gasket frame plate 180 also functions as a gasket plate for the seal gasket 112 as discussed below. The bottom plate 160 may be attached to the top plate 142 in any suitable way, e.g. by adhesive, fasteners, retainers, curable rubber, room temperature vulcanizing silicone ("RTV"), and welding. (The term adhesive is meant broadly and encompasses glue, epoxy, etc.). The top plate 142 and the bottom plate 160 may also be attached via the frame gasket plate 180, by fasteners such screws or rivets which can tighten the bottom plate 160 to the frame gasket plate 180 (and thereby to the top plate 142). One specific embodiment for attaching the bottom plate to the top plate is described below. In an embodiment, the frame 170 comprises an assembly that can be installed into the panel 110 as a unit.

The clamping device compartments 148 (FIGS. 5 and 6), discussed in more detail below, have a height substantially the same as that of panel 110 such that a clamping device with a clamping device compartment is manually accessible from the top of the top plate 142 through opening 147, and does not extend above the top of the panel.

According to an embodiment, the strips 172, the ribs 176, 178, the clamping device compartment 148, and the frame gasket plate 180 are made of Alloy 6061-T6.

Figure 8:
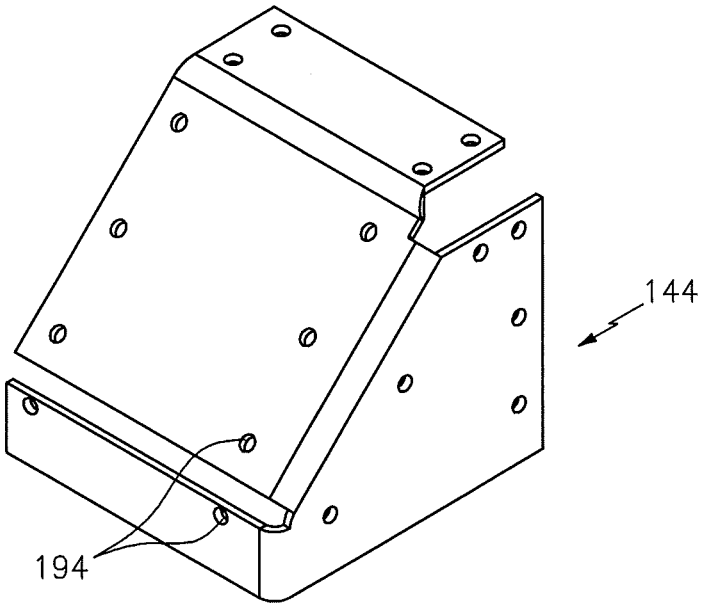
FIG. 8 is a perspective view of a corner plate of the panel depicted in FIG. 3 which is to be attached to the top plate.

Referring to FIG. 7, the top plate 142 is preferably made from a single sheet metal piece to facilitate providing a watertight enclosure. When a single piece of sheet metal is used, and depending on the pressing apparatus, discontinuities, e.g., gaps 192 at corners 190, may result from the pressing process that forms the enclosure, e.g., at the corners. These discontinuities are sealed and reinforced, e.g., in one embodiment by the corner brackets 144 (FIG. 8). However, in other embodiments the top plate may be fabricated from a plurality of plates that are attached watertight to form the watertight enclosure. The top plate 142 includes a plurality of openings 147 to access the clamping device compartment 148. The top plate 142 may be made of any suitable material, e.g., metals, metal alloys, composites, plastics, etc.

Figure 9A:
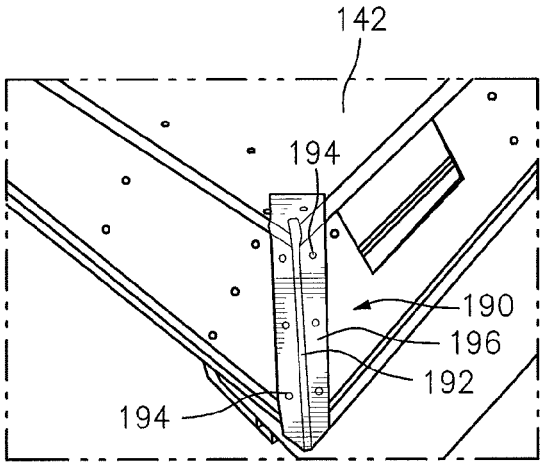
FIGS. 9A, 9B, and 9C are perspective views of a corner of the top plate of the panel depicted in FIG. 3 illustrating a process for attaching a corner plate.

A corner plate 144 (FIG. 8) may be used both on the inside and on the outside of the top plate 110 to seal and reinforce a corner. A respective corner plate 144 is configured to follow the contours of a respective corner 190 (FIG. 7) of the top plate 144 such that the corner plate 144 overlays and contacts at least those surfaces which have a discontinuity, or a gap 192 (FIGS. 7 and 9A). Corner plates may be manufactured according to any suitable process, die stamping or pressing. The corner plate 144 depicted in FIG. 8 includes gaps formed as a result of the particular manufacturing process used. A respective corner plate 144 and corner 190 include aligned holes 194 (FIGS. 7 and 8) that accept watertight fasteners such as screws, rivets, or bolts. According to an embodiment, a water impermeable fabric 196 may be provided between the corner plate 144 and a gap 198 in a top plate corner 190 to prevent water from leaking through the gaps 192 at the corners of the top plate. Any suitable water impermeable fabric may be used or formed in place, e.g., by coating a fabric mesh with one or more water impermeable materials, such as polymers or adhesives. This process does not use heat as, for example, welding, and therefore does not deform or weaken the corners which should have flat surfaces for contact with the seal gasket.

Figure 9B:
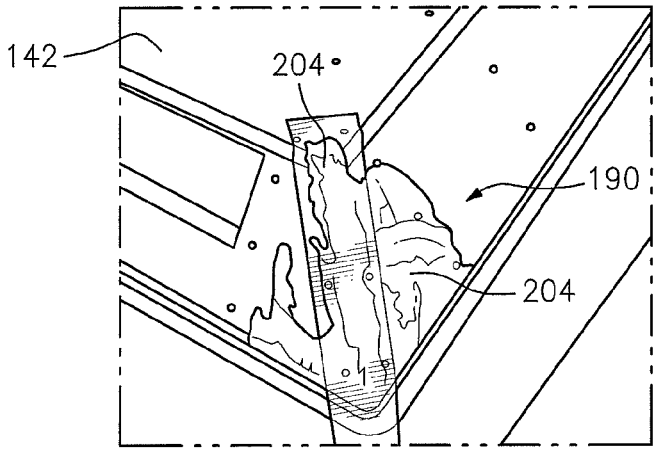
Figure 9C:
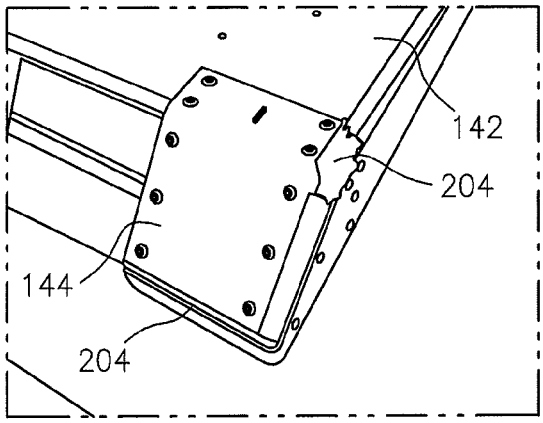

FIGS. 9A, 9B and 9C illustrate an embodiment of a method for sealing a corner 190 of the top plate 142. As shown in FIG. 9A, a fabric 196 has been secured to the corner by any suitable adhesive. A structural adhesive 204 may optionally be applied to the fabric 196 (FIG. 9B) to strengthen the corner and assist in attaching a corner plate to the corner. Any or all of the fabric 196, the adhesive securing the fabric to the corner and the structural adhesive may be waterproof. As depicted in FIG. 9C, the corner plate 144 is then attached to the corner 190 by screws 206 (or any other suitable fastener). Preferably, the corner plate 144 is attached before the adhesive cures so that the adhesive bonds the corner plate to the top plate corner. As long as a waterproof seal of the corner gaps 192 are achieved, and the corner is structurally sound, not all of the waterproof adhesive, the fabric and the structural adhesive have to be used.

Figure 10:
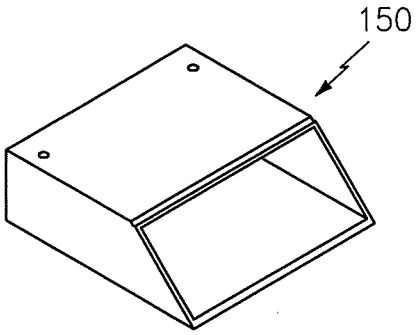
FIG. 10 is a perspective view of a pocket handle to be attached to the top plate of a panel.

FIG. 10 depicts an embodiment of an optional pocket handle 150 prior to installation, which can be installed watertight in an opening 151 in the top plate 142 in any suitable manner. Alternatively, the recessed handle 74 depicted in FIGS. 5 and 23 may optionally be provided.

Figure 11:
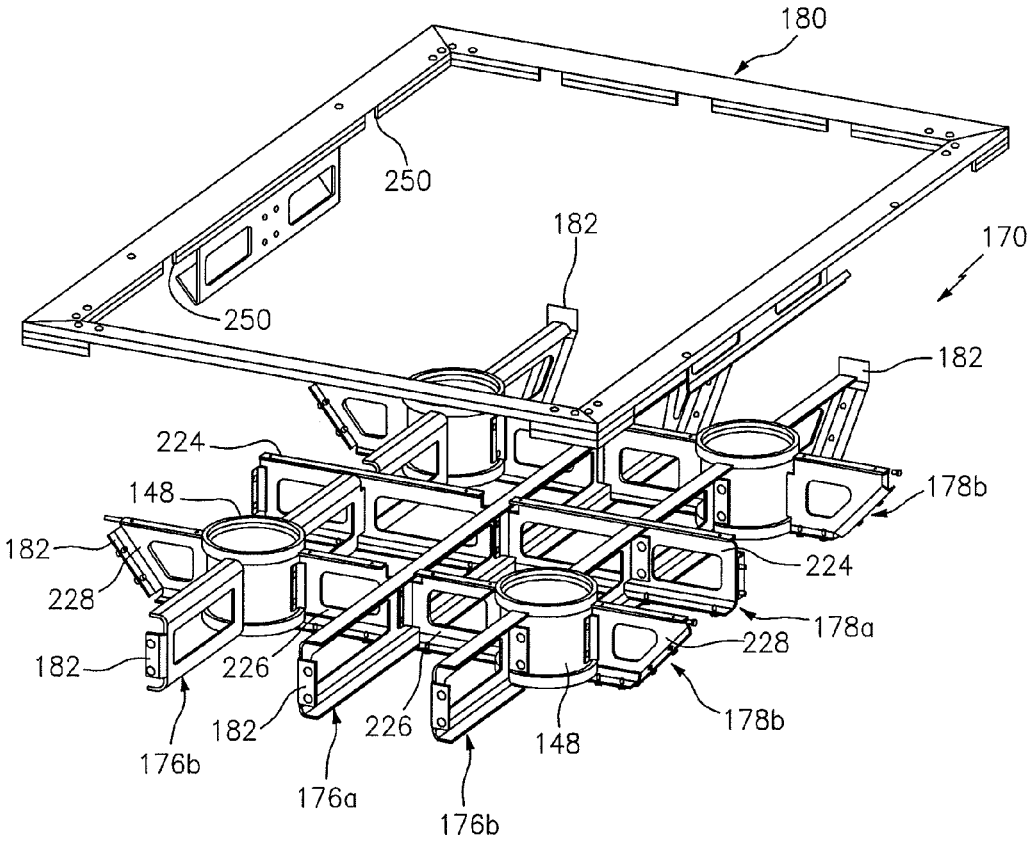
FIG. 11 is a bottom perspective view of a support frame of the panel depicted in FIG. 5 and a gasket frame plate which attaches a seal gasket to a panel.
Figure 12:
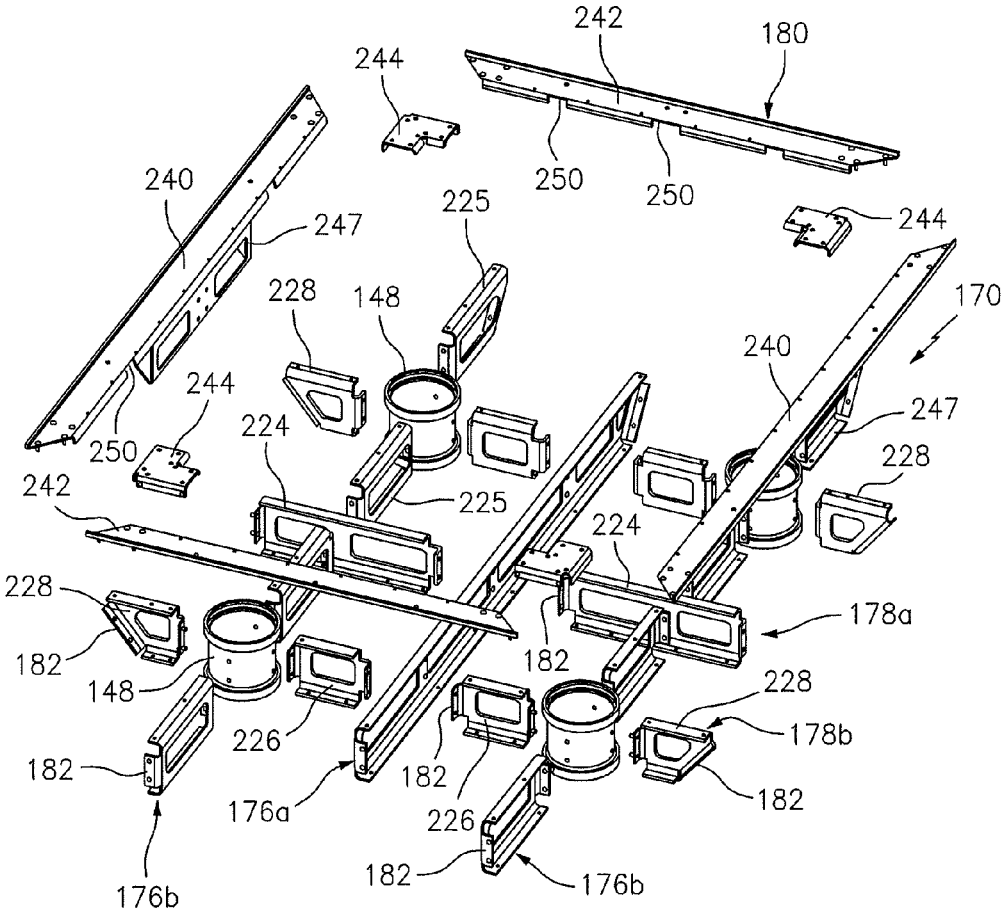
FIG. 12 is a top perspective view of the support frame and the gasket frame plate depicted in 11.

As described above, the frame 170 (FIGS. 5 and 6) comprises a plurality of longitudinal ribs 176 and a plurality of transverse ribs 178. As shown in FIGS. 11 and 12, one longitudinal rib 176*a*, the central longitudinal rib, spans the entire length of the top plate 142. The other longitudinal ribs 176*b*, which intersect the clamping device compartments 148, are made up of rib sections 225. One transverse rib 178*a*, the central transverse rib, is made up of two rib sections 224, and the other two transverse ribs 178*b* which intersect clamping device compartments 148, each comprise four rib sections—two central rib sections 226 and two end rib sections 228. According to an embodiment, the central portions of the rib sections are removed to reduce the weight of the cover system panel 110.

As depicted in FIGS. 11-12, each rib section of the longitudinal ribs 176*b*, and each rib section of the transverse ribs

178*b* end in a bent part or bracket 182, by which the respective rib section is attached to a side of the top plate 142, or a compartment 148, a rib or another rib section, as the case may be. The ends of the rib sections that are attached directly to the sides of the top plate 148 are configured to match the shape of the respective side, i.e., either angled or straight, as the case may be. Attachment may be made in any suitable way, e.g., with fasteners such as screws, rivets, or adhesives, or welding.

The frame 170 (FIGS. 11-12) also comprises the frame gasket plate 180 discussed above which operates as part of the frame and also with the seal gasket 112 (FIG. 5). The gasket frame plate 180 comprises two plate strips 240 and two plate strips 242, which are attached using corner brackets 246 into the periphery of a rectangular frame at the top plate enclosure opening. A flange or bracket 247 is attached to the bottom of each plate strip 240, and the ends of the center transverse rib sections 224 attached thereto to attach the central transverse rib 178*a* to the top plate 142 via the frame gasket plate 180. The plate strips 240, 242 have cutouts or recesses 250 which receive in interlocking fashion the tops of respective ribs.

Figure 13:
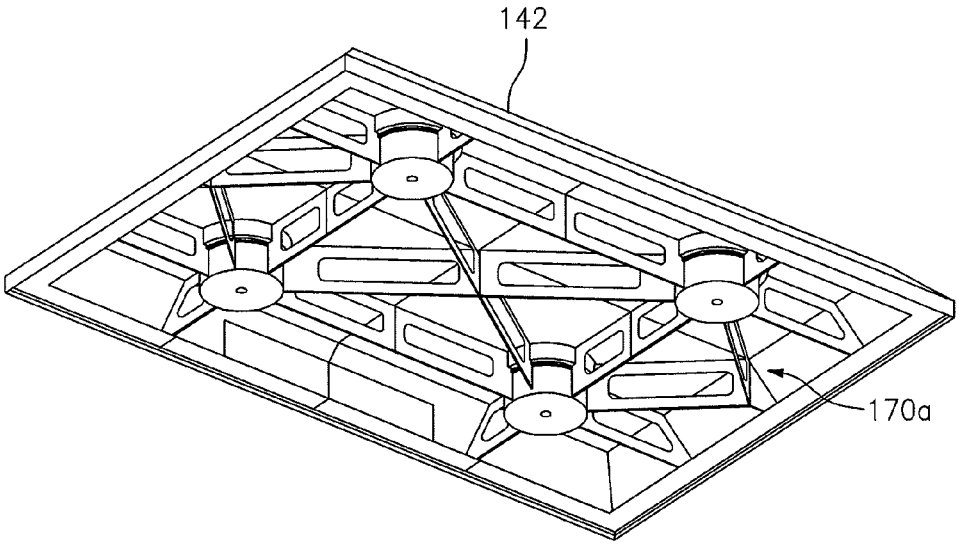
FIG. 13 is a bottom perspective view of the top plate of a panel and another embodiment of a support frame therein.

According to an embodiment, respective ribs extend parallel and perpendicular to the respective sides of the top plate 142. However, according to another embodiment, at least some of the ribs of frame 170*a* may extend along diagonals of the top plate 142, as shown in FIG. 13, or at other angles.

Figure 14A:
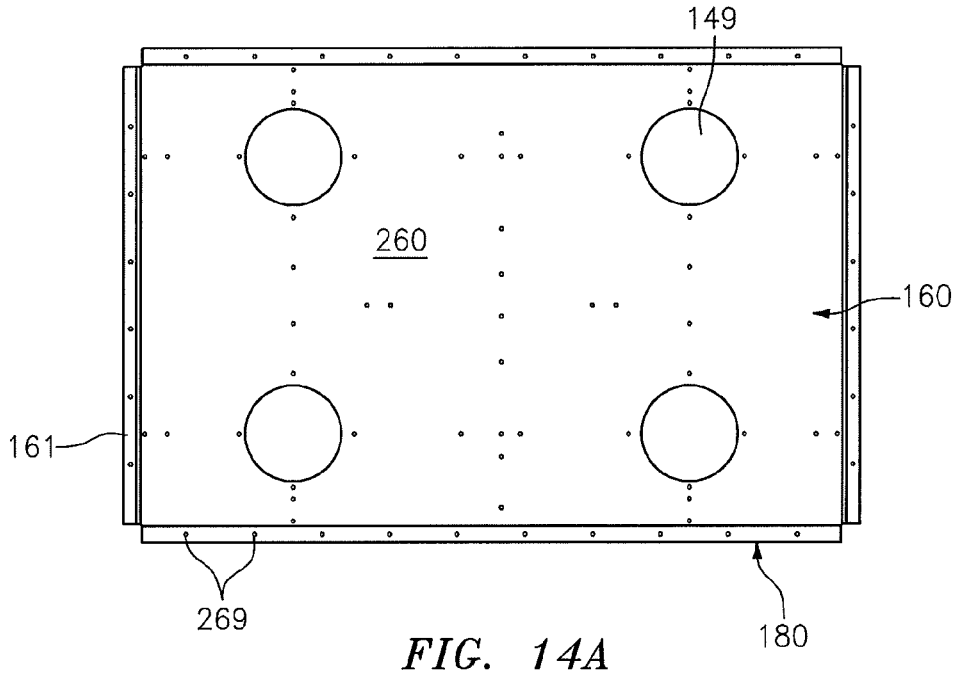
FIG. 14A is a top plan view of the bottom plate of a panel.

Referring to FIG. 14A, in one embodiment, the bottom plate 160 includes a central plate portion 260 and a raised skirt 161 surrounding the central plate portion 160. The raised skirt 161 adds strength to the bottom cover and resists flexing thereof. The central plate 260 includes a plurality of holes 149 for the clamping device compartments 148 (FIGS. 5-6).

Figure 14B:
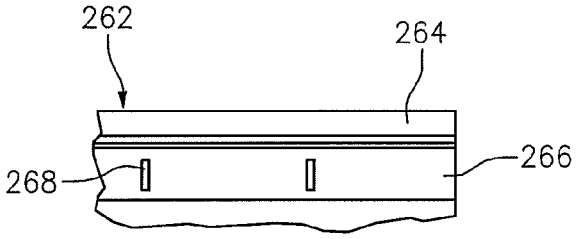
FIG. 14B is a top plan view of a portion of a pressure distribution strip used with the bottom plate to attach the bottom plate to the top plate.
Figure 14C:
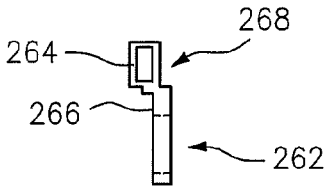
FIG. 14C is a side view of the pressure distribution strip.

As depicted in FIGS. 14B and C, pressure distribution strips 262 (e.g. of aluminum or the same material as the top and bottom plates include an inner section 264 and an outer section 266. A plurality of holes 268 are provided in the outer section 268 to attach the gasket frame plate 180 through the skirt 161 in the central plate 260 using fasteners such as screws or rivets. As depicted in FIG. 14C, the inner and outer sections 264, 266 of the strip 262 are offset, or stepped relative to each other to provide a clearance space 268 in which is received the flange 292 (FIGS. 15C, 16 and 21) of the seal gasket 112.

Figure 15A:
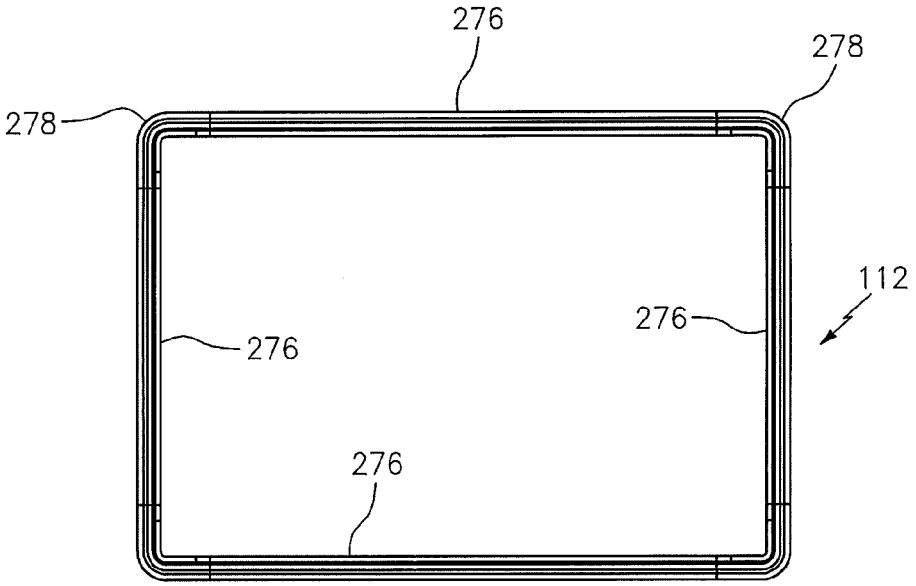
FIG. 15A is a top plan view of a seal gasket.
Figure 15B:
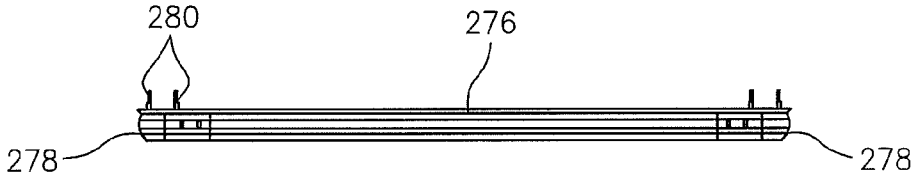
FIG. 15B is a side elevation view of the seal gasket.
Figure 15C:
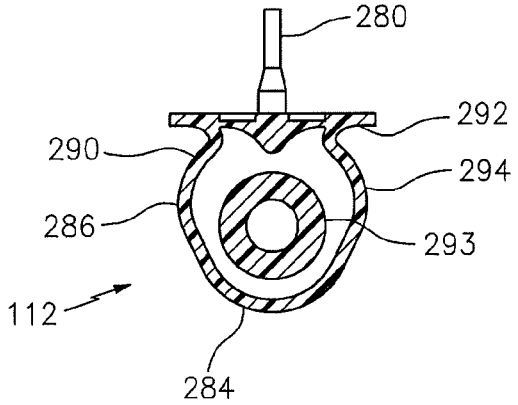
FIG. 15C is a radial sectional view of the seal gasket.

FIGS. 15A, 15B and 15C depict the seal gasket 112, which comprises a plurality of straight sections 276, adjacent ones of which are connected by a corner section 278. In one embodiment, the gasket sections have a tubular configuration (FIG. 15C) and are formed by an elastomeric material, e.g., rubber, foam, or polymer.

As shown in FIG. 15B, the corner section 278 of the seal gasket 112 may include a plurality of protrusions 280 that are received in holes in the gasket frame plate 180 to assist in positioning and attachment of the seal gasket during fabrication. The corner sections 278 may also include a plurality of holes 282 that allow air inside the bottom gasket 162 to exit as the seal gasket is compressed. However, the seal gasket 112 may be a solid tube in another embodiment.

An embodiment of a hollow tubular seal gasket 112 is depicted in FIG. 15C. Due to the tubular configuration of the seal gasket, the circumferential surface portion at the bottom 284 of the seal gasket where the gasket contacts the ground or the vent is narrow, while the central portion 286 has the largest configuration. The base 290 has a configuration whose size is between the central portion 286 and the bottom 284. According to an embodiment, the seal gasket 112 may comprise, at the base 290, a flange 292 that increases the area of the seal gasket to be secured to the bottom plate 160. According to an embodiment, the seal gasket 112 comprises an inner 293 tube and an outer tube 294, as shown in FIG. 15C. The inner tube 293 and the outer tube 294 may be made of the same or different materials, e.g., the materials described above for the seal gasket 112. The inner tube 293 may be a hollow tube or a solid tube.

Figure 16:
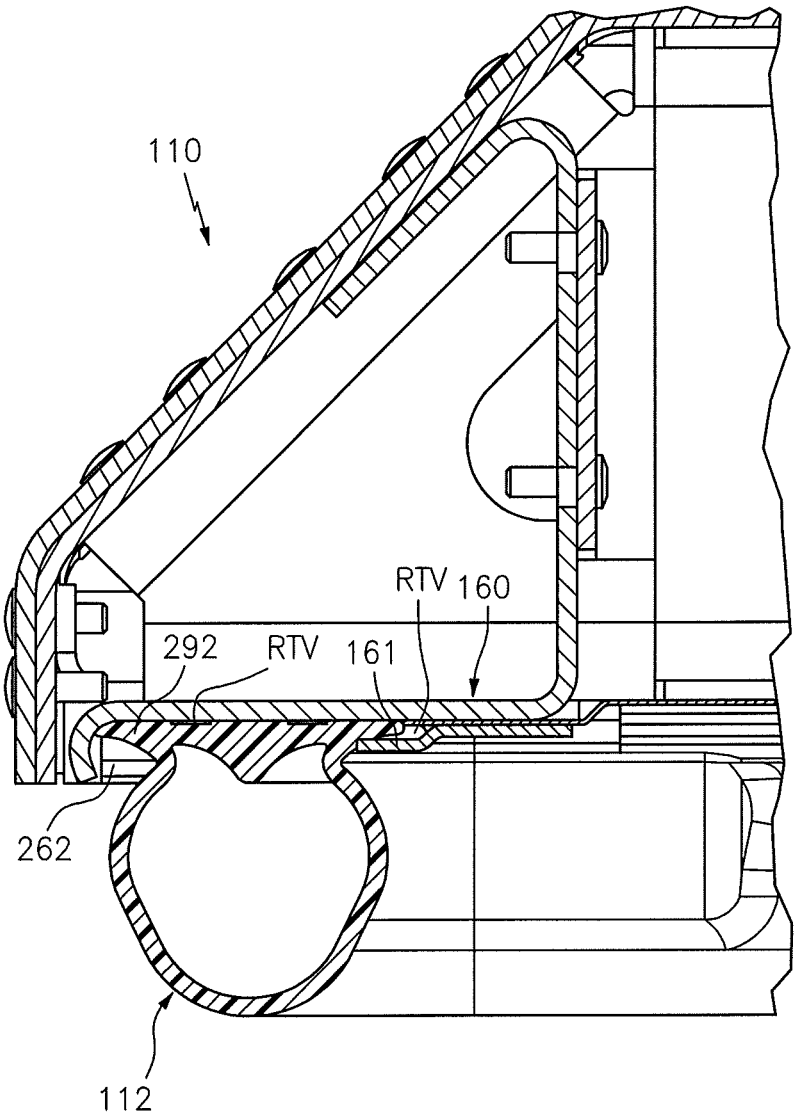
FIG. 16 is a side section view of a corner of a panel showing attachment of the gasket seal to the gasket frame plate of a panel.

FIG. 16 depicts the seal gasket 112 installed in the cover system panel 110. The flange 292 of the seal gasket 112 is attached to the bottom panel 160 in any suitable way, e.g., by fasteners such as screws and rivets, or adhesives, or RTV to provide a watertight connection with the bottom plate 160. In one embodiment, as depicted in FIG. 16, the seal gasket 112 is attached to the panel 110 using the frame plate 180 (FIG. 5), RTV, the flange 292 of the seal gasket (FIG. 15C), the bottom plate skirt 161 (FIG. 14A), and the pressure distribution strips 262 (FIG. 14B).

One method of attaching the gasket seal 112 in the cover system is as follows. After the frame 170 and the gasket frame plate 180 are installed in the top plate 142 (FIG. 5), RTV is applied to exposed top of the gasket frame plate 180. Then, the seal gasket 112 is positioned on the gasket frame plate 180 using the projections 280 on the seal gasket 112. Then, the bottom plate 160 is placed on the top plate 142 with the bottom cover skirt 161 on the seal gasket flange 292 (FIG. 15C). Then, the pressure distribution strips 262 (FIG. 14A) are positioned on the skirt 161 (FIG. 14A) and fasteners such as screws passing through aligned holes 268, 269 and 270 in the strips 262, skirt 161 and gasket from plate 180 are tightened to secure the seal gasket to the panel 110. The strips 262 help distribute pressure on the skirt 161 when the fasteners are tightened and help keep flat the skirt against the seal gasket flange 292. Additional RTV may be applied as needed, e.g., to seal any gaps between the strip plates 262, the skirt 161 and the frame plate 180, and at the to plate corners.

Figure 17:
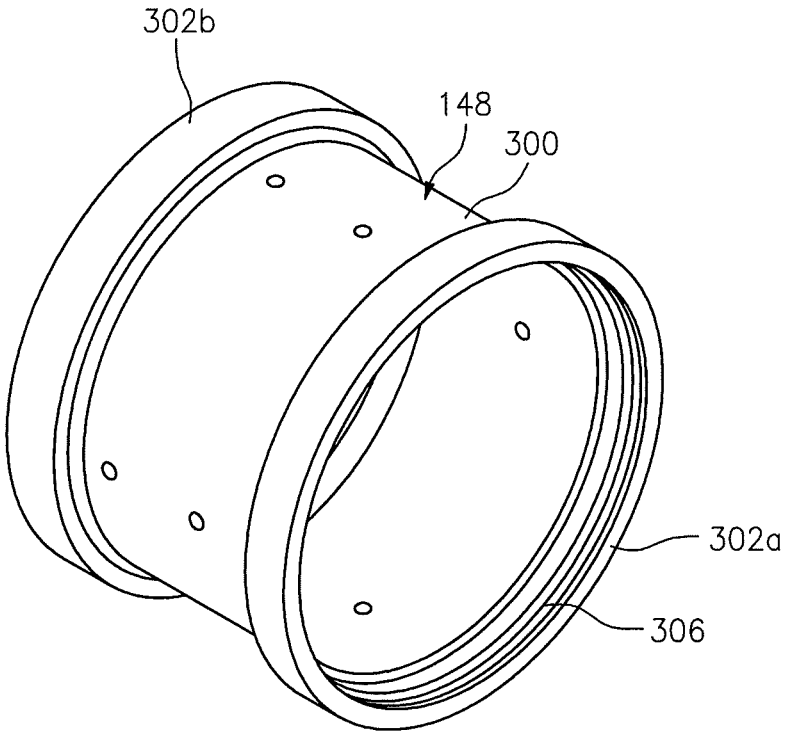
FIG. 17 is a perspective view of a housing of a clamping device compartment.
Figure 18:
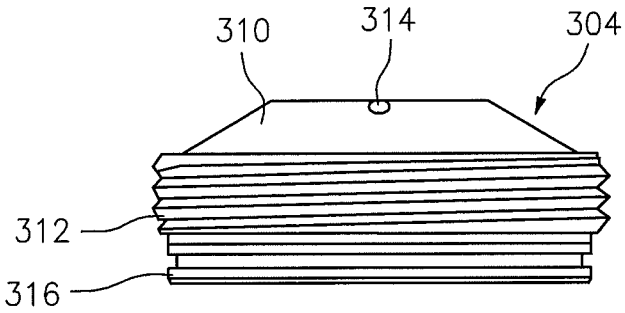
FIG. 18 is a side elevation view of a lid for the housing.

FIGS. 17-21 depict an embodiment of a clamping device 130 and a clamping device compartment 148. Referring to FIG. 17, a clamping device compartment comprises a tubular housing 300, which houses part of the clamping device 130. The housing 300 is sized to provide manual access thereto, as described above. The housing 300 includes larger diameter portions 302*a, b* at the ends thereof which are used to secure the clamping device to the housing, as described below. Larger diameter portion 302*a* includes internal threads 306 to receive a lid 304 (FIGS. 18, 2B, 3 and 20) to close and seal the fixture compartment 148 at the top of the cover system panel 110

Lid 304 (FIG. 18) includes a top 310 and external threads 312 below the top 310. The top 310 may include one or more slots 314 that provide contract points for a tool such as a screw driver engage to tighten and loosen the lid 304 to and from the compartment housing 300. The lid 304 may also include slots 315 (FIG. 20) to accommodate a two pronged spanner wrench or an installer's fingers so that the lid may be grasped by the wrench or the installer and rotated. According to an embodiment, the lid 304 includes an O-ring, 316 which, when compressed against the internal threads 306 (FIG. 17) of the compartment housing 300, forms a water tight connection between the lid and the compartment housing.

FIGS. 19 and 20 depict an embodiment of a J-hook clamping device 130, which includes an upper portion 320 and a lower portion 321. FIG. 20 depicts the assembled clamping device 130. The upper portion 320 includes a threaded shaft 322, a handle, 324, and a guide tube 326. The handle 324 includes internal threads 327 (FIG. 20) and is threaded to the shaft to axially move the shaft up and down by rotation of the handle. A set pin 330 received in a hole in the top of threaded shaft 322 acts as a stop for downward movement of the shaft 322 to prevent the shaft from rotating through and separating from the handle 324. The set pin 330 also can rotate the J-hook 360 degrees. This allows the installer who can see through the clamping device housing to the grate to successfully capture the J-hook under the grate bar. The guide tube 326 acts as a stop for upward movement of the shaft 322. The lower portion 321 includes a J-hook 130, which includes a hook part 340, and is attached to, and axially moves with, the threaded shaft 322. Movement of the shaft downwards moves the J-hook down so the hook part 340 can, e.g., be hooked to a grate bar (FIG. 1A, 2A, 2B) covering an opening 102. Movement of the shaft upwards moves the J-hook upward to engage the hook part 340 with, e.g., a grate bar, and allow the J-hook to be tightened, e.g., to the grate bar, and thereby clamp the cover system panel 110 to, e.g., the grate 105.

Referring to FIGS. 19 and 20, and a coil spring 332, coaxial with the shaft 322, is partially disposed inside the handle 324 and partially disposed in the guide tube 326 retained by a washer 333 and a retainer clip 334. The handle 324 is cup-shaped and is coaxial with the exterior of the guide tube 326. The spring 332 is compressed between the interior top of the handle and the retainer clip 334 to provide a biasing upward force against the handle. Depressing the handle 324 to compress the spring 332 moves the threaded shaft 322 downwardly to move the J-hook downwardly without having to rotate the handle. This facilitates positioning the J-hook under, e.g., a bar of a grate. Then, releasing the handle causes the J-hook to engage, e.g., the grate bar. Then, the handle may be rotated to tighten the J-hook against the grate bar. Rotation of the handle does not change compression of the spring. Therefore, depressing the handle produces the same lowering of the J-hook regardless of the position of the threaded shaft relative to the handle.

Referring to FIGS. 19 and 20, the guide tube 326 is held in the clamping device housing 300 by washers 346, 347, a retainer clip 348, an external shoulder 336 in the guide tube formed by a transition from a larger to a smaller diameter portion, a support ring 344, a retaining ring 346, and an annular slot 350 (FIG. 20) in the interior of the clamping device housing 300 at the bottom thereof. The support ring 344 has an inner circumferential portion 344*a* and an outer circumferential portion. 344*b*. The retaining ring 346 is held in the interior slot 350 at the bottom of the clamping device housing 300 with a portion extending radially into the housing 300, on which the outer circumferential portion 344*b* of the support ring 344 is supported. The inner circumferential portion 344*a* of the support ring 344 is retained between and supported by the washers 346 and 347. The upper washer 346 is held by the shoulder 336 in the guide tube 326, and the lower washer 347 is held by the retainer clip 348 held by the bottom of the guide tube 326.

Referring to FIGS. 19 and 20, a clevis 360 attaches the J-hook 130 to the shaft 322. The clevis 360 is closed at its top except for a central hole 362. The piston 360 is attached to the shaft 332 by a screw 364 passing through the hole 362 and threaded to internal screw threads in the shaft. The clevis 360 includes aligned holes 366, and the top of the J-hook 340 includes a flat with a hole 367 therethrough. A pin 370 passing through the holes 366, 367 pivotally attaches the J-hook 340 to the clevis 360. In another embodiment, a setscrew may be used instead of a pin. In such an embodiment, the setscrew and one or both holes are threaded. The pin 370 allows the J-hook to pivotally rotate around the pin. For example, the J-hook may be pivoted 90 degrees to be parallel with the bottom plate 160 to facilitate storage and transportation. The J-hook may also be pivoted to facilitate installation of the cover system panel 110, as described above.

The clamping device housing 300 (FIG. 20), closed by the lid 304, is watertight.

Although the particular clamping device described herein comprises a J-hook, any suitable clamping or other type device may be used that can provide for attachment of the cover system panel 110 to a grate, or the periphery of an opening. Also in the case of a J-hook, the hook part 341 may have any suitable configuration, e.g., T- or arrow-shaped.

During installation, a worker depresses the handle 324 to move the hook 341 of the J-hook under a grate or other structure associated with an opening. (Prior to depressing the handle, it may be necessary to adjust the position of the hook part 341 relative to the structure to be engaged so that depressing the handle then moves the hook part 341 under the structure to be engaged.) Then, rotating the handle tightens the J-hook against the structure to be engaged to clamp the cover system panel 110 over the opening. To remove the cover system, the handle may be simple depressed to disengage the hook part from the structure engaged, but it may be necessary top first rotate the handle to loosen engagement of the hook part 341.

Figure 21:
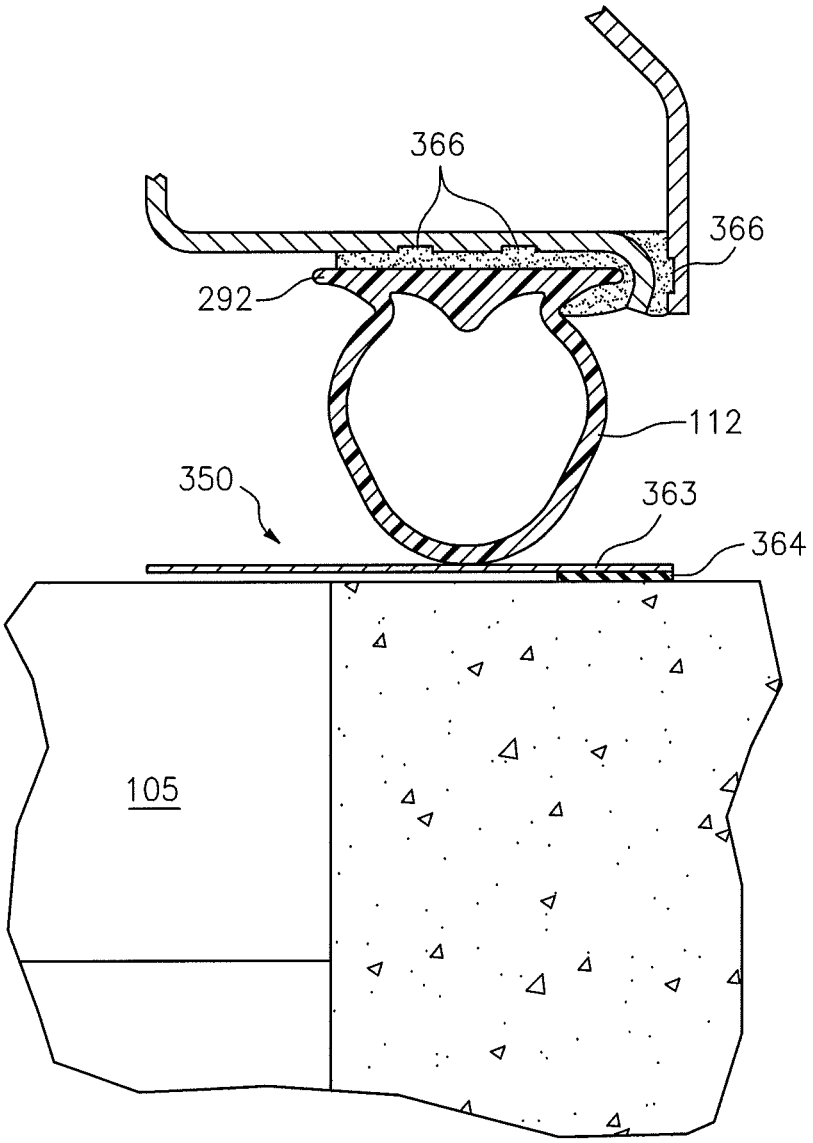
FIG. 21 is a side section view of a flashing system for grates and uneven surfaces and the bottom of a panel with a seal gasket attached thereto.
Figure 22:
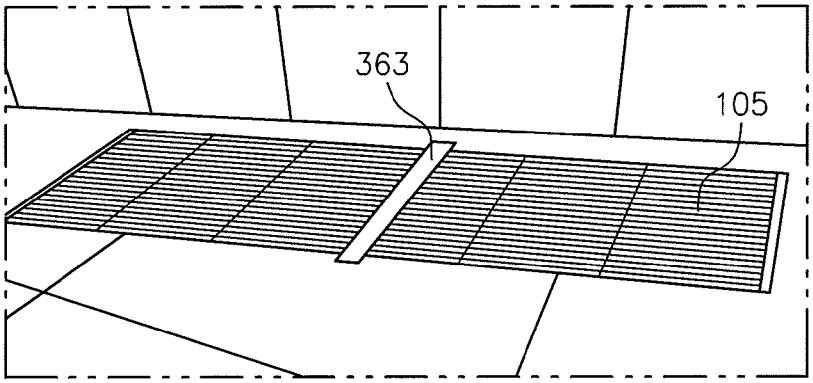
FIG. 22 is a top perspective view of an opening closed by a grate and a flashing strip of the flashing system of FIG. 20 on the grate.

FIGS. 21, 22A and 22B illustrate an embodiment of a sealing system 350 for sealing a side of a cover system extending over a grate (as opposed to the structure surrounding a grate) or over an uneven surface. In practical applications, situations exist when surface surrounding a side of an opening is not flat or properly leveled, or when the support strip between adjacent openings is not be wide enough to support a seal gasket 112 or two seal gaskets, or when the particular opening is large with a single grate covering it (FIG. 1) (with or without an intermediate support). In such applications, some pre-treatment may be needed in order to provide a good seal between the cover system and the ground. According to an embodiment, a flashing structure 360 is installed between the seal gasket 112 and the ground support.

Referring to FIGS. 21, 22A and 22B, an embodiment of a sealing structure 350 includes a flexible metal (e.g., stainless steel plate or an aluminum) plate or flashing 363 attached at its upper surface by, e.g., waterproof adhesive to the bottom of the seal gasket 112 and at its bottom to a grate or ground structure by, e.g., fasteners and/or adhesive. According to various embodiments, the metal plate 363 is wider than the width of the seal gasket 112, may be smooth or may have a textured surface, and/or is flexible/pliant enough to adapt to rough and uneven ground structure. According to an embodiment, the seal system 350 may be provided with a weather strip 364, e.g. of foam, rubber or other suitable material. As mentioned above, the seal gasket 112 is attached to the bottom of the bottom panel by an adhesive 366 such as RTV, which also fills gaps between the bottom plate and the frame plate 26.

Figure 24A:
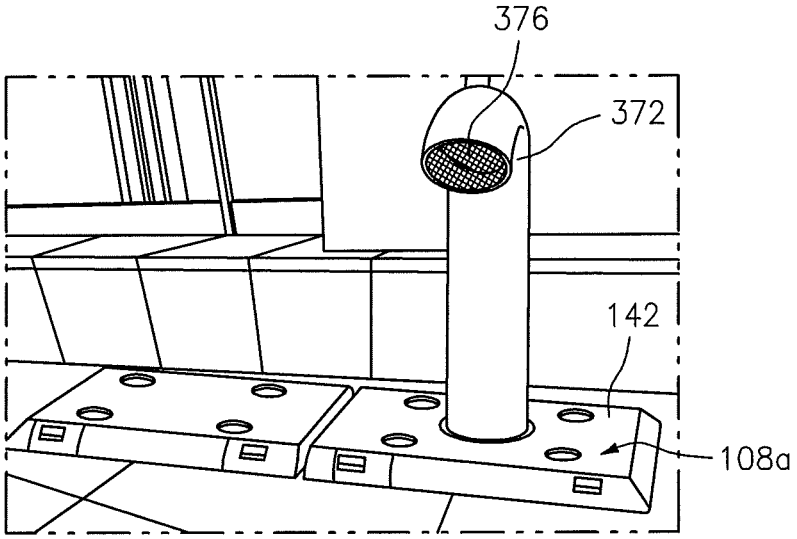
FIGS. 24A and 24B are perspective views of a panel with an installed vent pipe.
Figure 24B:
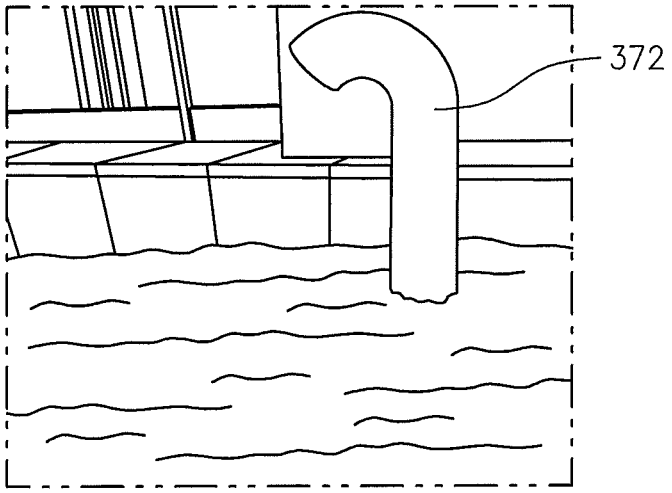

FIGS. 24A and 24B illustrate an embodiment of a cover system 108*a* with a vent for air or other gases. The vent allows for complete flood control over a ventilator while allowing a transformer or generator to continue operating, or to protect electrical wires, junctions, etc., during the flood event. Such equipment requires significant air to keep operating (or cooled) and will cease to function without sufficient air. In the embodiment depicted in FIGS. 24A and 24B, the vent is embodied by a vent pipe 370 screwed watertight into a hole in the top plate 142. The bottom of the pipe 370 is open and exposed to the environment below the cover system panel. The top of the vent pipe is of inverted J-configuration, and includes a downwardly facing opening 372 covered by a screen 376. Other embodiments of vents may also be provided.

Figure 25A:
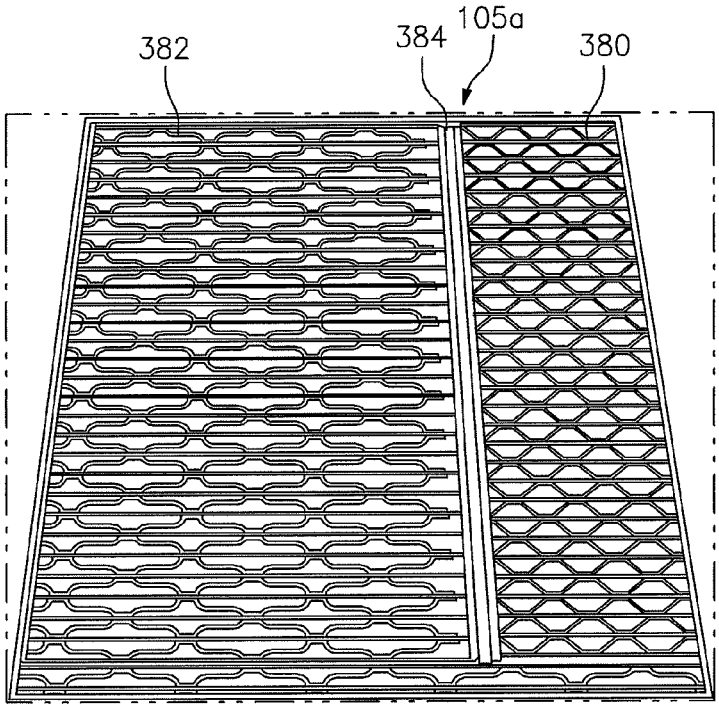
FIG. 25A is a perspective view of a grate with a hinged section.
Figure 25B:
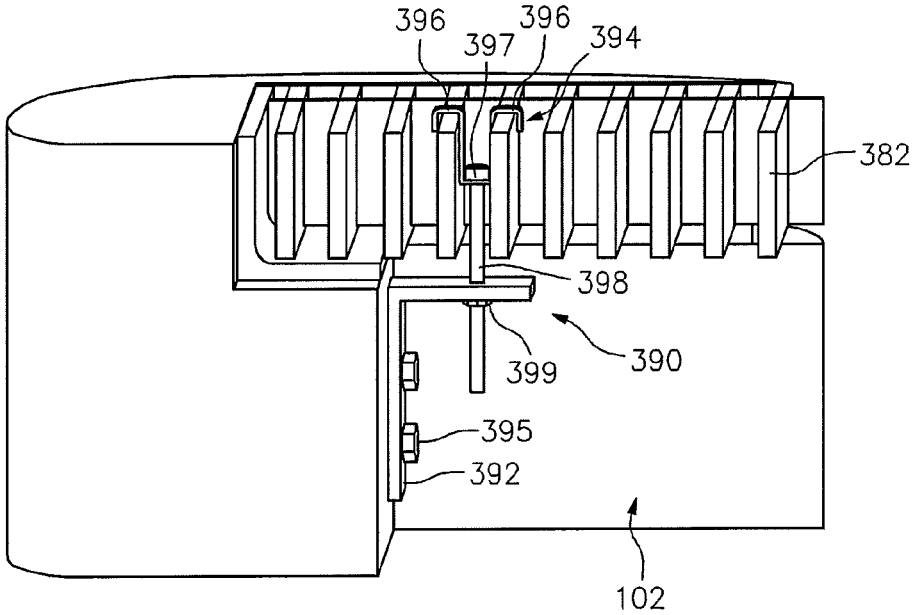
FIG. 25B is an illustration showing a grate clamping device clamping the hinged section to structure in an opening.

Some grates for openings include a hinged part to provide access to the opening. As depicted in FIG. 25A, a grate 105*a* comprises a stationary part 380 and a movable part 382 pivotally attached to the stationary part 380 by a piano-type hinge 384 (or a plurality of hinges). Because the hinged part 382 can be raised, a cover system clamped to the hinged part 382 is subject to being moved by external forces applied to the cover system. Referring to FIG. 25B, the hinged part 382 may be secured to the opening by a grate clamping device 390 so as to prevent it from being raised. According to an embodiment, the device 390 includes a wall bracket 392 and a grate bracket or clip 394. The wall bracket 392 is attached to the side of the opening 102 by bolts 395. The clip 394 includes hooks 396 which engage respective grate bars, and a central part 397 with a hole in it. A bolt 398 engages the central part 397 and the top of the bracket 392 via a nut 399. Tightening the bolt clamps the grate to the bracket 394 to prevent the hinged part 382 of the grate from being raised.

According to an embodiment, the cover systems and components may be stored in transport and storage boxes with J-shaped hooks in a storage position, which is parallel with the main surface of the cover system. After the cover system is taken out of the storage boxes, the J-shaped hooks are pulled down to an attachment position, which extends vertically from the bottom of the cover. After all hooks are unlatched, the cover system is brought on top of the grate and the J-shaped hooks are aligned with the slots between the grate bars. After the seal gasket is aligned with the perimeter of the vent, the cover system is lowered to cover the grate such that the seal gasket seals the opening. The J-shaped hooks may be aligned with the grate slots to be attached to the bottom of the grate by using the handle or knob at the top of the threaded rod/shaft. Once each of the J-hooks are aligned with the grate slots and the cover system top is aligned to the sealing area around the grate, installers can tighten the J-hooks handles using respective until the cover system is snugly tight and compresses the seal all around the vent cover. The lids are then screwed to the clamping device housings to seal the cover system.

The cover system is removable from the vent by loosening the J-hooks and raising them into or above the grate slots by using the clamping device handle, as described above. Then, the cover system may be lifted from the opening.

As pointed out above, an opening may be covered by a single cover system panel 110, or a plurality of cover system panels 110. Where more than one panel is needed to cover an opening, a flashing system 360 or other supporting or sealing structure may be needed or desirable.

The particular embodiments disclosed above are illustrative only, as the disclosed embodiments may be modified and practiced in different but equivalent manners apparent to those skilled in the art having the benefit of the teachings herein. Furthermore, the claims are not intended to be limited only to the details of construction or design herein shown, other than as described in the claims. It is therefore evident that the particular embodiments disclosed above may be altered or modified and all such variations are considered within the scope and spirit of applicable claims. Although illustrative embodiments have been described in detail herein with reference to the accompanying drawings, it is to be understood that the claims are not limited to those precise embodiments, and that various changes and modifications can be effected therein by one skilled in the art without departing from the scope and spirit of the claims.

What is claimed is:

1. A cover system for covering a facilities opening watertight, comprising:

a waterproof panel and a seal gasket configured to extend peripherally relative to the panel and the facilities opening, and adapted to be positioned between the panel and the periphery of the opening;

the panel comprising a top plate defining an enclosure with an open end and a bottom plate closing the enclosure watertight in which are at least partially disposed one or more clamping devices; and the one or more clamping devices being adapted to engage the panel and the periphery of the facilities opening and/or structure extending over and attached to the facilities opening to clamp the panel over the facilities opening and compress the seal gasket, wherein the panel comprises a clamping device opening in the top thereof for each clamping device and a lid that attaches to the respective clamping device opening watertight, a respective clamping device being accessible through the respective clamping device opening without the respective lid.

2. The cover system of claim 1, wherein at least one of the clamping devices comprises a hook structure at the bottom thereof which is adapted to engage a bar of a grate installed over the facilities opening.

3. The cover system of claim 1, wherein at least one of the clamping devices comprises a hook structure at the bottom thereof which is adapted to engage a ledge or other structure associated with the facilities opening.

4. The cover system of claim 1, wherein at least one of the clamping devices comprises a hook structure at the bottom thereof which is adapted to engage a beam extending over the facilities opening.

5. The cover system of claim 1, wherein the seal gasket is attached to the panel, and the panel with at least the seal gasket forms an assembly installable as one piece.

6. The cover system of claim 1, comprising a housing within the panel for each clamping device, the housing comprising an upper end having threads thereon, wherein the lid comprises threads mating with the threads of the housing to provide a watertight when the lid id threaded to the housing.

7. A cover system for covering a facilities opening watertight, comprising:

a waterproof panel and a seal gasket configured to extend peripherally relative to the panel and the facilities opening, and adapted to be positioned between the panel and the periphery of the opening;

the panel comprising a top plate defining an enclosure with an open end and a bottom plate closing the enclosure watertight in which are at least partially disposed one or more clamping devices; and the one or more clamping devices being adapted to engage the panel and the periphery of the facilities opening and/or structure extending over and attached to the facilities opening to clamp the panel over the facilities opening and compress the seal gasket, wherein the panel further comprises a frame disposed within the enclosure, and wherein the seal gasket comprises a flange which is held between the top plate and the bottom plate at the periphery of the open end of the enclosure to attach the seal gasket to the panel, at least the top plate, the frame, the bottom plate and the seal gasket forming an assembly installable as one piece.

8. The cover system of claim 7, wherein the cover system comprises a gasket frame plate attached to the periphery the open end of the top plate, and wherein the seal gasket is disposed between the gasket frame plate and the bottom plate.

* * * * *